US012220789B2

(12) United States Patent
Song et al.

(10) Patent No.: US 12,220,789 B2
(45) Date of Patent: Feb. 11, 2025

(54) HIGH-ROTATIONAL SPEED CUP-SHAPED GRINDING WHEEL

(71) Applicant: GUILIN CHAMPION UNION DIAMOND CO., LTD., Guilin (CN)

(72) Inventors: Jingxin Song, Guilin (CN); Anning Liang, Guilin (CN); Huiling Long, Guilin (CN); Yong Ye, Guilin (CN); Zhiyong Wang, Guilin (CN); Liang Zhao, Guilin (CN); Fengming Qin, Guilin (CN)

(73) Assignee: GUILIN CHAMPION UNION DIAMOND CO., LTD., Guilin (CN)

( * ) Notice: Subject to any disclaimer, the term of this patent is extended or adjusted under 35 U.S.C. 154(b) by 363 days.

(21) Appl. No.: 17/916,066

(22) PCT Filed: Mar. 12, 2021

(86) PCT No.: PCT/CN2021/080405
§ 371 (c)(1),
(2) Date: Sep. 30, 2022

(87) PCT Pub. No.: WO2021/197027
PCT Pub. Date: Oct. 7, 2021

(65) Prior Publication Data

US 2023/0166383 A1 Jun. 1, 2023

(30) Foreign Application Priority Data

Mar. 30, 2020 (CN) ..... 202010238283.9
Mar. 30, 2020 (CN) ..... 202020434168.4
(Continued)

(51) Int. Cl.
*B24D 7/10* (2006.01)
*B24B 55/02* (2006.01)
(Continued)

(52) U.S. Cl.
CPC ..... *B24D 7/10* (2013.01); *B24B 55/02* (2013.01); *B24D 7/18* (2013.01)

(58) Field of Classification Search
CPC ... B24D 5/10; B24D 7/02; B24D 7/06; B24D 7/10; B24D 7/18; B24B 55/02; B24B 55/03; B24B 55/10
(Continued)

(56) References Cited

U.S. PATENT DOCUMENTS 1,600,054 A * 9/1926 MacLaughlin ..... B24D 7/10 451/450
3,161,995 A * 12/1964 Lindblad ..... B24D 7/10 451/449
(Continued)

FOREIGN PATENT DOCUMENTS

CN 203156587 U 8/2013
CN 106903567 A 6/2017
(Continued)

*Primary Examiner* — Eileen P Morgan
(74) *Attorney, Agent, or Firm* — Bayramoglu Law Offices LLC

(57) ABSTRACT

A high-rotational speed cup-shaped grinding wheel includes an annular base, several blades and a flow splitting structure. The blades are fixed on a side of the base at an interval in a circumferential direction to form a blade ring. The side of the blade ring away from the base forms an annular working surface, and two adjacent blades are spaced apart from each other to form a water passage channel for delivering cooling water to the working surface. The flow splitting structure is fixed on the blade ring and splits the cooling water into two branches, where a first branch delivers the cooling water to an outer area of the working surface, and a second branch delivers the cooling water to an inner area of the working surface, and then delivers the cooling water from an inner area of the working surface to an outer side area thereof.

20 Claims, 13 Drawing Sheets

(30) Foreign Application Priority Data

Apr. 15, 2020 (CN) ..... 202010295353.4
Apr. 15, 2020 (CN) ..... 202020556608.3

(51) Int. Cl.
*B24B 55/03* (2006.01)
*B24D 7/18* (2006.01)

(58) Field of Classification Search
USPC ..... 451/53, 449, 450, 488, 541, 547, 548
See application file for complete search history.

(56) References Cited

U.S. PATENT DOCUMENTS 5,993,297 A * 11/1999 Hyatt ..... B24D 7/16
451/450
6,224,473 B1 * 5/2001 Miller ..... B24D 7/18
451/529
9,011,206 B2 * 4/2015 Ishizu ..... B24D 7/10
451/542
2001/0011004 A1 * 8/2001 Yamaguchi ..... B24D 7/06
451/548
2009/0098808 A1 * 4/2009 Kajiyama ..... B24B 1/00
451/36
2012/0288677 A1 * 11/2012 Ishizu ..... B24B 7/228
451/36
2017/0080547 A1 * 3/2017 Fujiya ..... B24D 7/06
2019/0134782 A1 * 5/2019 Tateishi ..... B24D 7/06
2023/0166383 A1 * 6/2023 Song ..... B24D 7/18
451/548
2023/0294245 A1 * 9/2023 Song ..... B24D 5/10
451/488

FOREIGN PATENT DOCUMENTS

CN 108188945 A 6/2018
CN 111438643 A 7/2020
EP 3260236 A2 12/2017
WO WO-2011086715 A1 * 7/2011 ..... B24B 7/228

* cited by examiner

HIGH-ROTATIONAL SPEED CUP-SHAPED GRINDING WHEEL

CROSS REFERENCE TO THE RELATED APPLICATIONS

This application is the national phase entry of International Application No. PCT/CN2021/080405, filed on Mar. 12, 2021, which is based upon and claims priority to Chinese Patent Applications No. 202010238283.9, filed on Mar. 30, 2020; No. 202020434168.4, filed on Mar. 30, 2020; No. 202010295353.4, filed on Apr. 15, 2020; and No. 202020556608.3, filed on Apr. 15, 2020; the entire contents of which are incorporated herein by reference.

TECHNICAL FIELD

The invention relates to the field of super-hard material grinding tools, and in particular to a high-rotational speed cup-shaped grinding wheel.

BACKGROUND

The diamond working blade ring, used in a cup-shaped grinding wheel of the existing medium-and-low-rotational speed machining technology, mainly adopts a form of a through blade ring (including an oblique through gear), an inner blade ring (including a helical inner gear), an outer blade ring (including a helical outer gear), and a blade-free ring. During high-rotational speed machining, a layer of "airflow barrier" will be formed on an inner wall, an outer wall and a working surface of the grinding wheel. The above-mentioned forms of cup-shaped grinding wheels all suffer from a defect that cooling water cannot fully act on the entire working surface under the action of the "airflow barrier" and centrifugal force. Therefore, the cup-shaped grinding wheel in the prior art cannot adapt to high-rotational speed machining, which will be explained as follows:

Two adjacent blades of through-blade ring-type cup-shaped grinding wheels in the prior art (see FIGS. 1-4) are spaced apart to form a water passage channel for conveying cooling water to the working surface, and the water passage channel is a through structure in the radial direction of the blade ring. When the cup-shaped grinding wheel rotates at a high speed, most of the cooling water entering the blade ring through an inner radial cavity will be thrown out toward outside of the blade ring through the water passage channel under centrifugal force, since the water passage channel is a through structure in the radial direction of the blade ring (as illustrated by the arrow in FIG. 3), and the cooling effect on the working surface is extremely poor. Moreover, the quantity of cooling water flowing along the inner wall of the blade ring to the working surface is very small, and the water in the beam state is easily to be dispersed into small water droplets by the "airflow barrier", which attenuates the cooling effect. Therefore, an area of the working surface close to the inner side of the blade ring has no or insufficient cooling water, failing to achieve sufficient cooling.

In the inner blade ring-type cup-shaped grinding wheel of the prior art (see FIGS. 5-7), the outer side of the blade ring is blocked, that is, an end of a water passage channel close to the outer side of the blade ring is blocked. When the cup-shaped grinding wheel rotates at a high speed, most of the cooling water entering the blade ring through the inner radial cavity will tend to gather at the end of the water passage channel close to the outer side of the blade ring under centrifugal force, and be thrown out from an area of the working surface close to the outside of the blade ring (as illustrated by the arrow in FIG. 6), and the area of the working surface close to the outside of the blade ring can be sufficiently cooled at this time. However, the area of the working surface close to the inner side of the blade ring has no or insufficient cooling water, failing to achieve sufficient cooling.

Blade-free ring-type cup-shaped grinding wheel (see FIG. 8) in the prior art is adapted to continuous machining and is not prone to edge chipping. However, since there is no water passage channel, the cooling capacity is extremely low. In the outer blade ring-type cup-shaped grinding wheel (see FIG. 9) of the prior art, there are chip removal grooves between the blades, but cooling water cannot enter therein. Therefore, the blade-free ring and outer blade ring of the prior art are less likely to accommodate high-rotational speed machining.

During high-rotational speed machining, if the cooling water is applied to the grinding zone along a circumferential direction of the grinding wheel, and then the cooling water is applied in a direction from the outer diameter to the inner diameter, the cooling water will be strongly affected by the "airflow barrier" and centrifugal force, and it will be difficult for the cooling water to enter the grinding zone, leading to a poor cooling effect. Therefore, during high-rotational speed machining, most of the cooling water should enter the inner diameter cavity, covering the working surface from the inside to the outside, in order to obtain a good cooling effect.

SUMMARY

To sum up, the technical problem to be solved by the present invention is to provide a high-rotational speed cup-shaped grinding wheel in order to overcome the deficiencies of the prior art.

The technical solution of the present invention to solve the above technical problems is as follows. A high-rotational speed cup-shaped grinding wheel includes an annular base and a plurality of blades. The blades are arranged at an interval in a circumferential direction and are fixed on a side of the base to form a blade ring, a side of the blade ring away from the base is an annular working surface, and two adjacent blades are spaced apart to form a water passage channel for delivering cooling water to the working surface. The high-rotational speed cup-shaped grinding wheel further includes a flow splitting structure. The flow splitting structure is fixed on the blade ring and divides the cooling water into two branches, wherein a first branch delivers the cooling water to an outer area of the working surface through an interior of the water passage channel under a centrifugal force due to rotation of the base, and a second branch delivers the cooling water to an inner area of the working surface through an exterior of the water passage channel under a centrifugal force due to rotation of the base, and delivers the cooling water from an inner area of the working surface to an outer side area thereof upon being blocked by a machined workpiece.

The beneficial effects of the present invention are as follow: when the cup-shaped grinding wheel rotates at a high speed, the cooling water entering the inner diameter cavity can be divided into two branches by virtue of centrifugal force, and the two branches are used to deliver the cooling water to the inner and outer areas of the working surface respectively, and then the cooling water completely covers the working surface and fully implements cooling, which provides a cooling guarantee for high-speed, high-quality and high-efficiency grinding.

On the basis of above-mentioned technical solution, the present invention can implement further improvements as described below.

Further, the flow splitting structure includes an outer ring body and an inner ring body; the outer ring body is fixed on an outer side of the blade ring, the inner ring body is fixed on an inner side of the blade ring, and a water passage hole that is in communication with the water passage channel is provided at a sidewall of the inner ring body that corresponds to the water passage channel, whereby the first branch is formed from the water passage hole to the outer area of the working surface through the water passage channel, and the second branch is formed from an inner sidewall of the inner ring body to the inner area of the working surface.

The beneficial effect of adopting the above-mentioned further technical solution is that the cooling water entering the inner diameter cavity can be divided into two branches, and the two branches deliver the cooling water to the inner and outer areas of the working surface respectively.

Further, the water passage hole is an annular structure, and is provided on the sidewall of the inner ring body in a circle.

Further, the water passage hole is located on the sidewall of the inner ring body at an end away from the working surface.

The beneficial effect of adopting the above-mentioned further technical solution is that when the cooling water is supplied to the inner diameter cavity passing through the base, or when the cooling water is supplied from the direction of working end face to the direction of the inner diameter cavity and the base is provided with a confluence device, the cooling water within the base is restricted from being divided into two branches, to thereby improve the utilization of cooling water and make the cooling water more evenly distributed on the working surface.

Further, water passage hole is an annular structure, and is provided on the sidewall of the inner ring body in two or more circles.

The beneficial effect of adopting the above-mentioned further technical solution is that when the cooling water is supplied by spraying from the direction of the working end face to the direction of the inner diameter cavity and the base is not provided with the confluence device, the utilization of the cooling water can be improved, and the cooling water can be more evenly distributed on the work surface.

Further, the inner and outer ends of the blade are respectively provided with a second arc block and a first arc block, and notches are respectively provided on both sides of the second arc block; after the blades are fixed on the base, the first arc blocks on all the blades are spliced to form the outer ring body, and the second arc blocks on all the blades are spliced to form the inner ring body; and after two adjacent second arc blocks are spliced, the notches on them are butted to form the water passage holes that communicate with the corresponding water passage channels.

Further, the first arc block and the second arc block are integrally formed with the corresponding blades.

Further, the water passage channel is a straight groove structure that is radially consistent with the base.

Further, the water passage channel is an oblique groove structure radially inclined relative to the base.

Further, a connecting plate connected with a spindle of a machine tool is further included, and the connecting plate is fixed on a side of the base away from the blade ring.

The beneficial effect of adopting the above-mentioned further technical solution is to realize the connection with the spindle of the machine tool.

Further, a plurality of grooves is provided on one or both sides of the water passage channel, a position of the working surface corresponding to the groove is prone to rapid wear and forms a circumferential trough, and the trough and the water passage channel are interlaced to form a slot with a mesh structure on the working surface.

The beneficial effect of adopting the above-mentioned further technical scheme is that the groove body with the mesh structure enables the cooling water to be distributed to various positions on the working surface, thereby making it easier for the cooling water to completely cover the working surface and fully implement cooling.

Further, the grooves are arranged on different diameters of the blade ring, a connecting line of the grooves on the same-diameter circumference of the blade ring is in the form of a single arc or multiple arcs that are uniformly disposed, the length of the single arc is at most half a circle of a corresponding circumference, and a cumulative length of the multiple arcs is at most half a circle of a corresponding circumference.

The beneficial effects of adopting the above-mentioned further technical solution are: the grooves on the same-diameter circumference are designed into the shape of waves that do not penetrate the entire circumference, that is, concave and convex parts are formed on the circumference; when the grinding wheel is edging, slight axial and radial vibrations will be generated, which can achieves an effect of impact-type intermittent grinding; and the blockage from powder chips is frequently relaxed, which greatly increases the effects of chip removal and cooling.

Further, thicknesses of the outer ring body and the inner ring body may be set at 3 mm or less or 1 mm or less.

Further, when a linear rotational speed of the base reaches 45 m/s or more, an end of the water passage channel close to an outer side of the blade ring is inclined by an angle $\theta$ toward the direction of rotation of the base with respect to an end of the water passage channel close to an inner side of the blade ring, and the higher the linear rotational speed of the base, the greater the value of the angle $\theta$.

The beneficial effects of adopting the above-mentioned further technical solutions are that, when the grinding wheel rotates at a high speed to a certain value, it avoids the deficiency that excessive cooling water is quickly thrown out from the end face of the outer ring of the grinding wheel due to the increase of centrifugal force, but the inner ring working surface is short of water for cooling. The water passage channel is arranged in the reverse direction, which achieves the effect of preventing rapid radial leakage of cooling water and forms a "spring" effect, which is conducive to enhancing the cooling effect of cooling water on the working surface.

Figure 1:
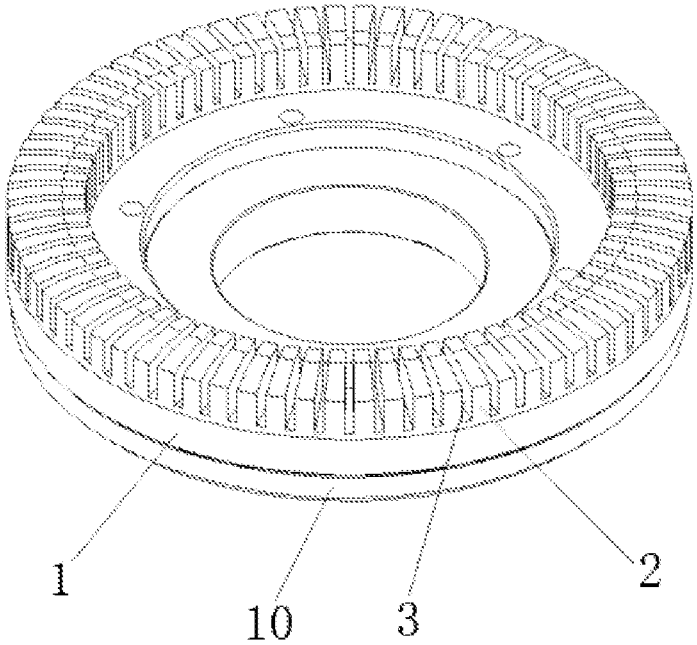
FIG. 1 (Prior Art)
FIG. 1 is a schematic diagram for illustrating a structure of a through blade ring-type cup-shaped grinding wheel of the prior art.
Figure 2:
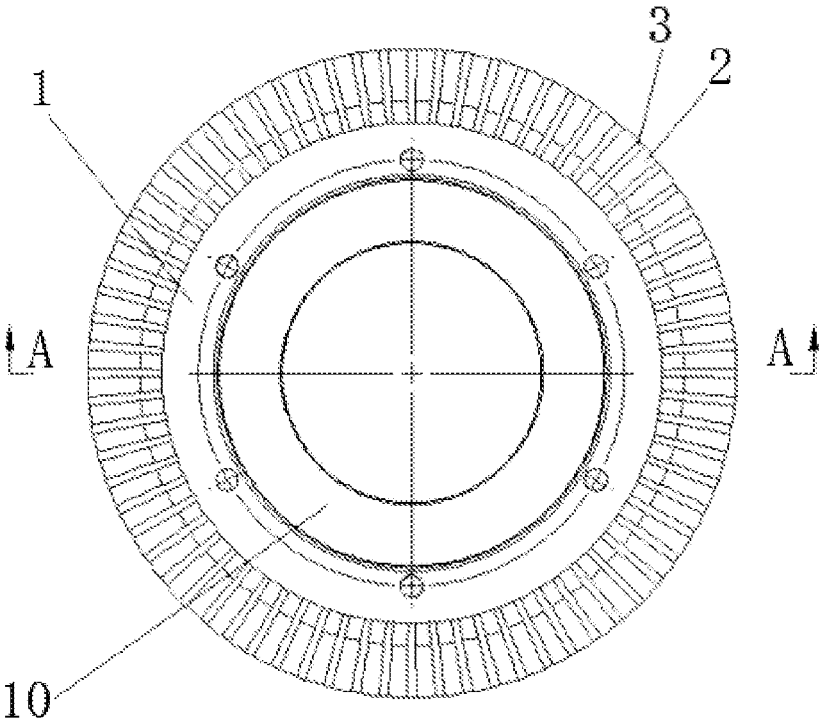
FIG. 2 (Prior Art)
FIG. 2 is the top view of FIG. 1.
Figure 3:
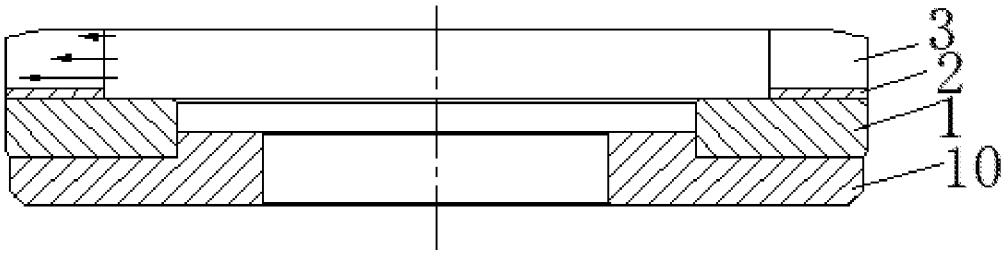
FIG. 3 (Prior Art)
FIG. 3 is the sectional view along A-A of FIG. 2.
Figure 4:
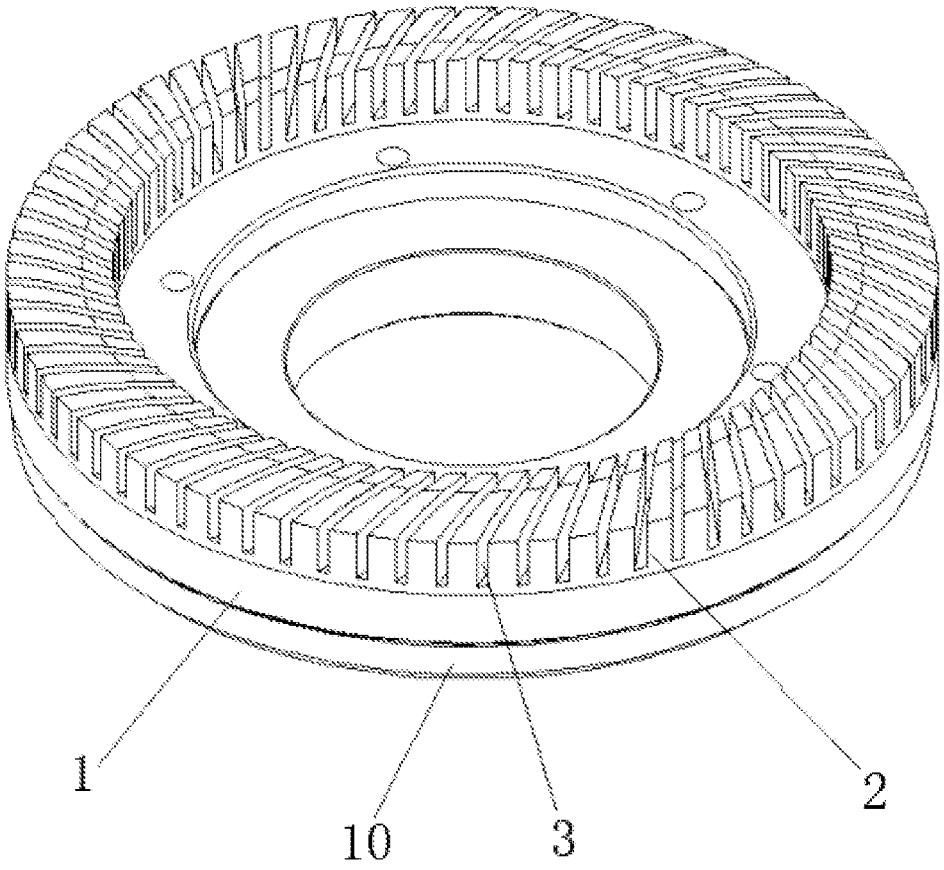
FIG. 4 (Prior Art)
FIG. 4 is a schematic diagram for illustrating a structure of an oblique through blade ring-type cup-shaped grinding wheel of the prior art.
Figure 5:
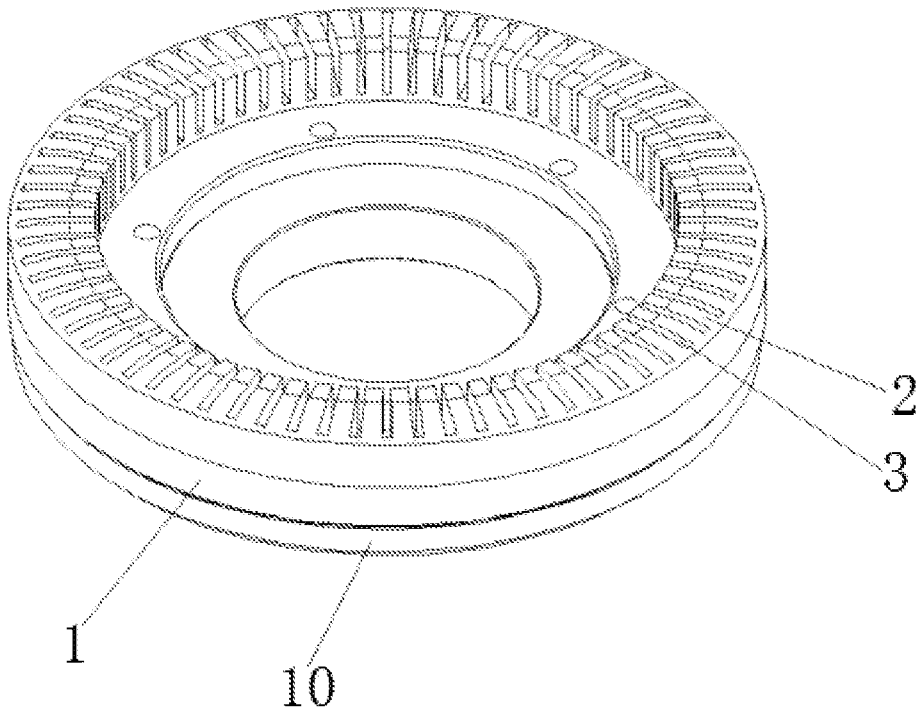
FIG. 5 (Prior Art)
FIG. 5 is a schematic diagram for illustrating a structure of an inner blade ring-type cup-shaped grinding wheel of the prior art.
Figure 6:
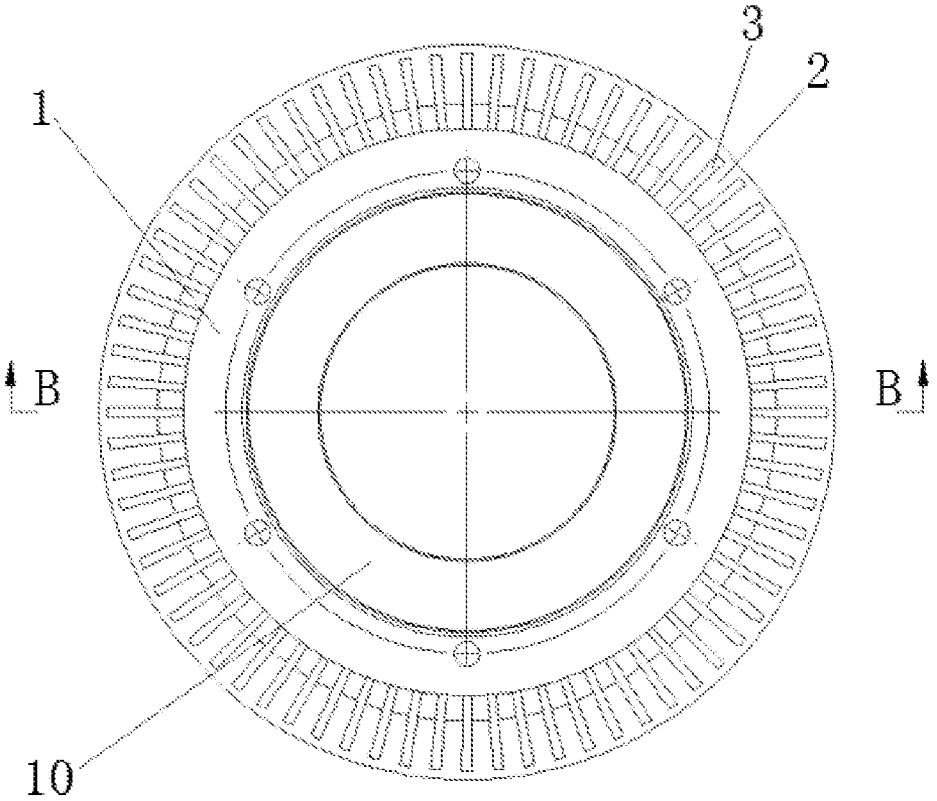
FIG. 6 (Prior Art)
FIG. 6 is the top view of FIG. 5.
Figure 7:
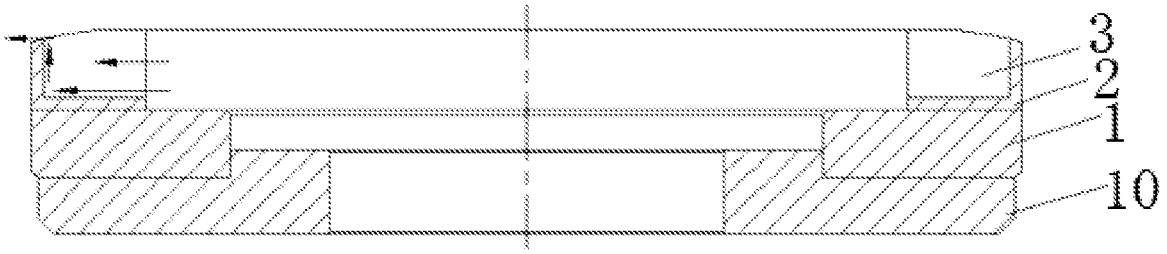
FIG. 7 (Prior Art)
FIG. 7 is the sectional view along B-B of FIG. 6.
Figure 8:
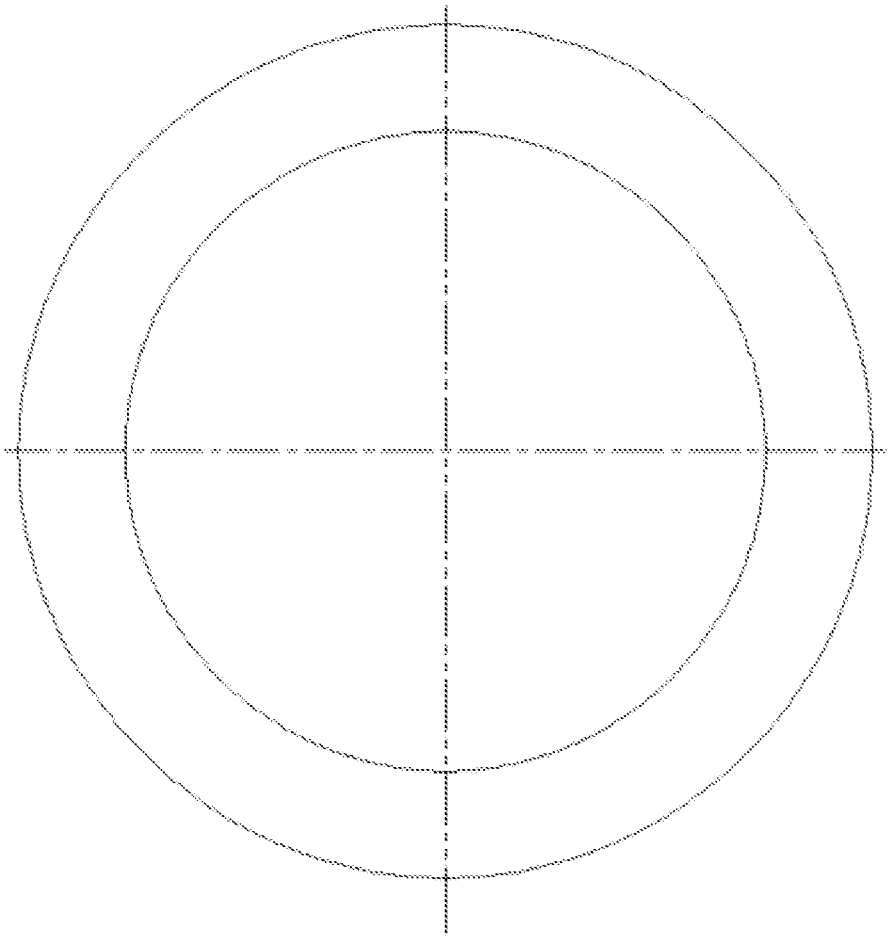
FIG. 8 (Prior Art)
FIG. 8 is a schematic diagram for illustrating a structure of a blade-free ring-type cup-shaped grinding wheel of the prior art.
Figure 9:
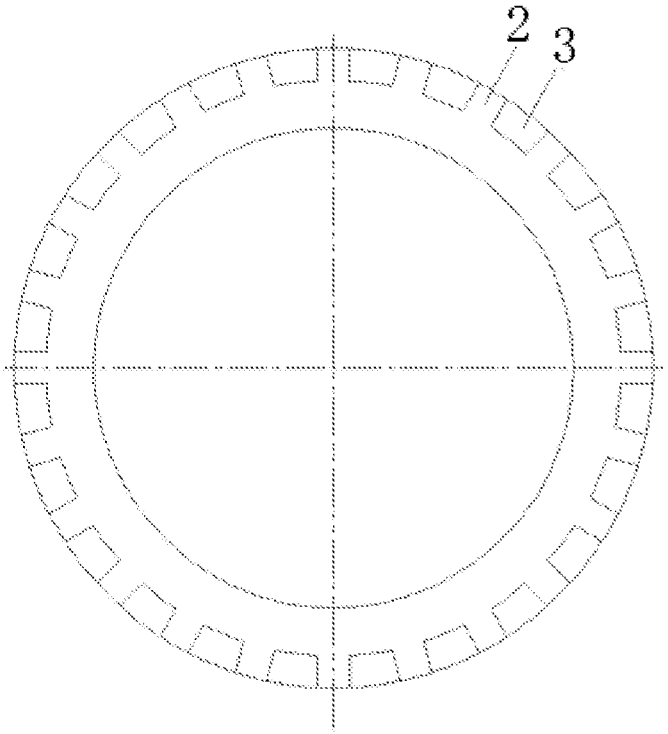
FIG. 9 (Prior Art)
FIG. 9 is a schematic diagram for illustrating a structure of an outer blade ring-type cup-shaped grinding wheel of the prior art.

In the drawings, the arrows indicate the flow direction of the cooling water or the rotation direction of the grinding wheel.

In the drawings, the list of components represented by each number is as follows:

1. Base, 2. Blade, 3. Water passage channel, 4. Outer ring, 5. Inner ring, 6. Water passage hole, 7. First arc block, 8. Second arc block, 9. Notch, 10. Connecting plate, 11. Groove, 12. Trough.

DETAILED DESCRIPTION OF THE EMBODIMENTS

The principles and features of the present invention will be described below with reference to the accompanying drawings. The examples are only used to explain the present invention, but not to limit the scope of the present invention.

First Embodiment

Figure 10:
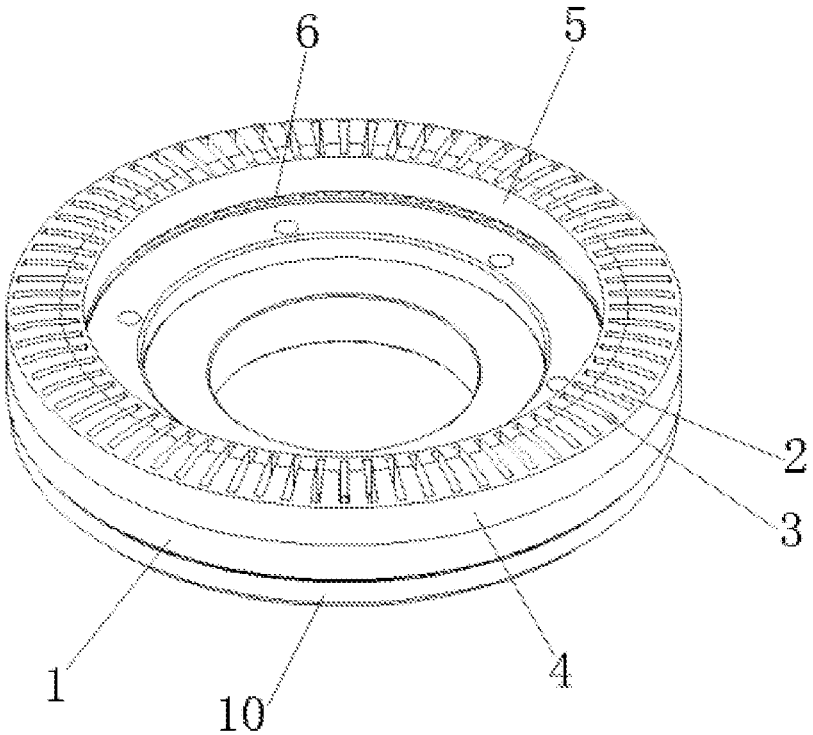
FIG. 10 is a three-dimensional view of a first embodiment in accordance with the present invention.
Figure 11:
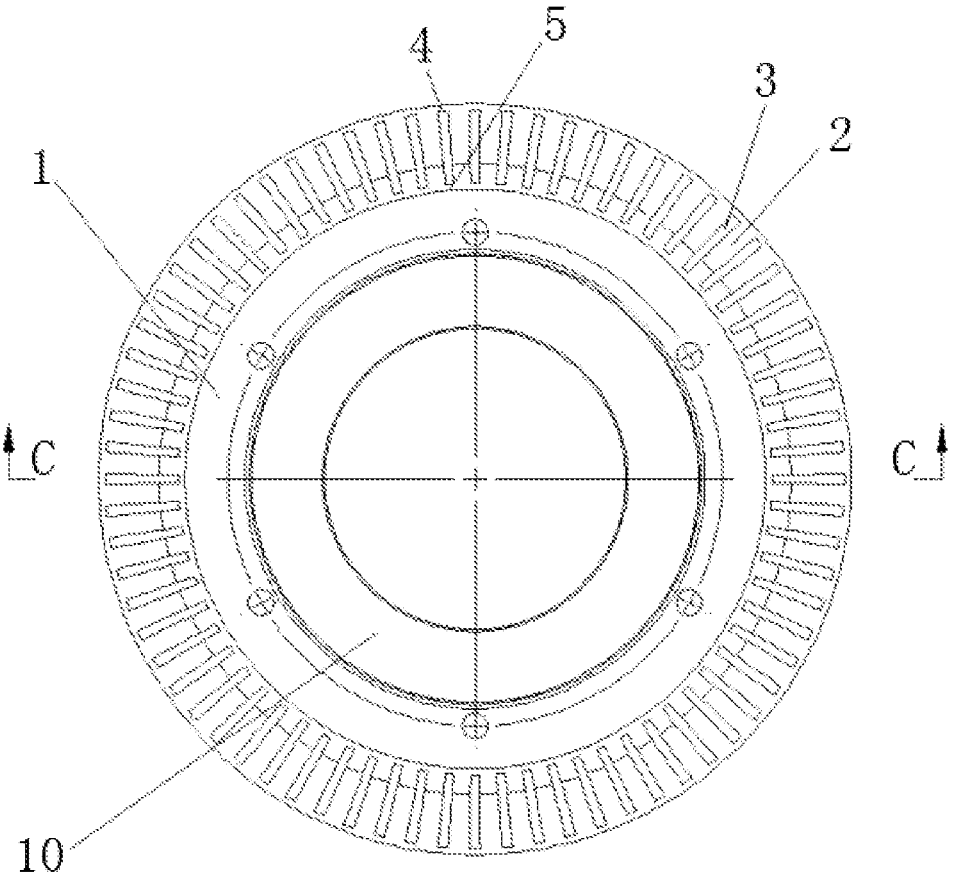
FIG. 11 is the top view of FIG. 10.
Figure 12:
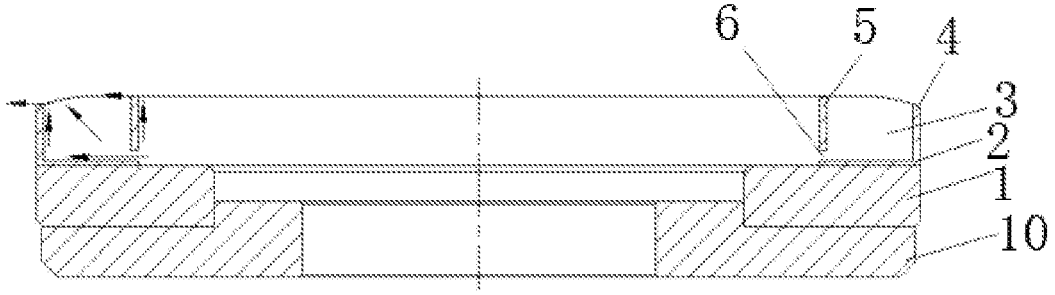
FIG. 12 is the sectional view along C-C of FIG. 11.

As shown in FIGS. 10-12, a high-rotational speed cup-shaped grinding wheel may include an annular base 1, a plurality of blades 2, and a connecting plate 10 connected to a spindle of a machine tool. One side of the blade 2 arranged at intervals in a circumferential direction and fixed on the base 1 forms a blade ring, and the side of the blade ring away from the base 1 is an annular working surface, and two adjacent blades 2 are spaced apart to form a water passage channel 3 for delivering cooling water to the working surface. The water passage channel 3 is a straight groove structure that is radially consistent with the base 1, or the water passage channel 3 is an oblique groove structure that is inclined radially relative to the base 1. The connecting plate 10 is fixed on a side of the base 1 away from the blade ring.

The cup wheel also includes a flow splitting structure. The flow splitting structure is fixed to the blade ring and divides the cooling water into two branches, in which a first branch delivers the cooling water to the outer area of the working surface through the interior of the water passage channel 3 under the action of the centrifugal force due to the rotation of the base 1, and a second branch delivers the cooling water to the inner area of the working surface through the exterior of the water passage channel 3 (that is, the inner wall of the grinding wheel) under the action of the centrifugal force due to the rotation of the base 1. The cooling water is then delivered from an inner area of the working surface to an outer side area thereof upon being blocked by the machined workpiece. The flow splitting structure includes an outer ring body 4 and an inner ring body 5. The outer ring body 4 is fixed on the outer side of the blade ring, the inner ring body 5 is fixed on the inner side of the blade ring, and a water passage hole 6 that communicates with the water passage channel 3 is provided at a position on the sidewall of the inner ring body 5 corresponding to the water channel 3. As a result, the first branch is formed from the water passage hole 6 to the outer area of the working surface through the water passage channel 3, and the second branch is formed the inner sidewall of the inner ring body 5 to the inner side of the working surface. The thickness of the outer ring body 4 and the inner ring body 5 is set at 3 mm or less, and the optimal thickness is 1 mm or less. The water passage hole 6 is an annular structure, which is provided on the sidewall of the inner ring body 5 in a circle and is positioned on the sidewall of the inner ring body 5 at an end away from the working surface.

During operation, the cooling water entering the blade ring is blocked by the inner ring body 5 under the action of the centrifugal force caused by the high-speed rotation of the cup-shaped grinding wheel, preventing all the cooling water from entering the water passage channel 3. Since the inner ring body 5 is provided with a water passage hole 6, the cooling water inside the blade ring will be divided into two branches.

The flow path of the first branch is as follows: a part of the cooling water enters the water passage channel 3 from the inside of the blade ring through the water passage hole 6, and after the cooling water enters the water passage channel 3, it flows down the inner wall of the outer ring body 4 toward the outer area of the working surface in an axial direction of the blade ring while being blocked by the outer ring body 4, thereby cooling the outer area of the working surface;

The flow path of the second branch is as follows: under the action of the flow restriction by the water passage hole 6, another part of the cooling water flows down the inner wall of the inner ring body 5 toward the inner area of the working surface in an axial direction of the blade ring, to thereby cool the inner area of the working surface, and cool the inner area of the working surface before flowing to the outer area of the working surface.

To sum up, water flows of the two branches cool the inner and outer areas of the working surface respectively, and finally achieve the effect of cooling the working surface in an all-round way, avoiding the existence of areas on the working surface that cannot be cooled by the cooling water, which greatly improves the machining quality.

Second Embodiment

This embodiment improves the structure of the water passage hole 6 on the basis of the first embodiment, the other parts are consistent with the first embodiment, and the details are described as follows.

Figure 13:
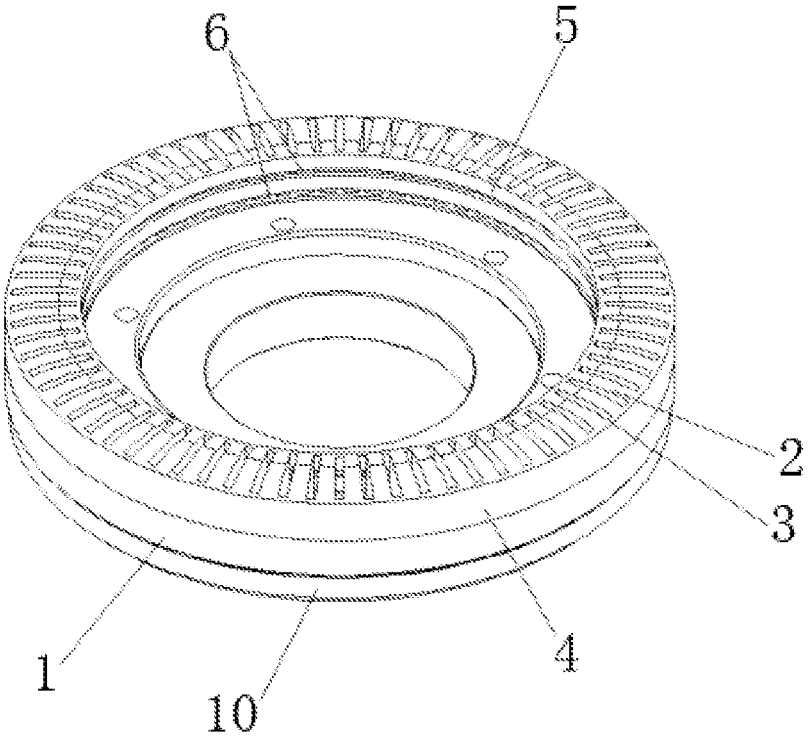
FIG. 13 is a three-dimensional view of a second embodiment in accordance with the present invention.
Figure 14:
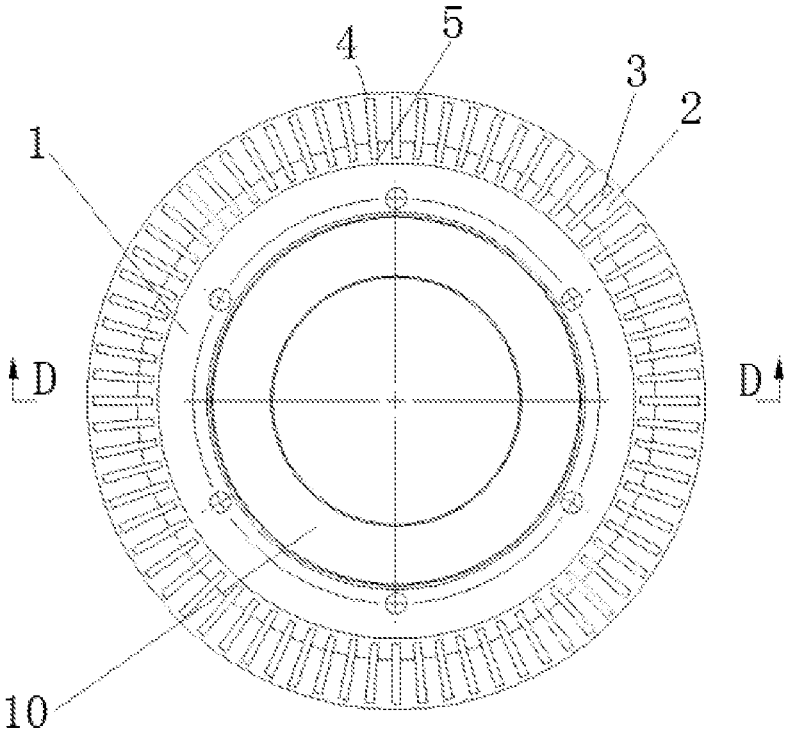
FIG. 14 is the top view of FIG. 13.
Figure 15:
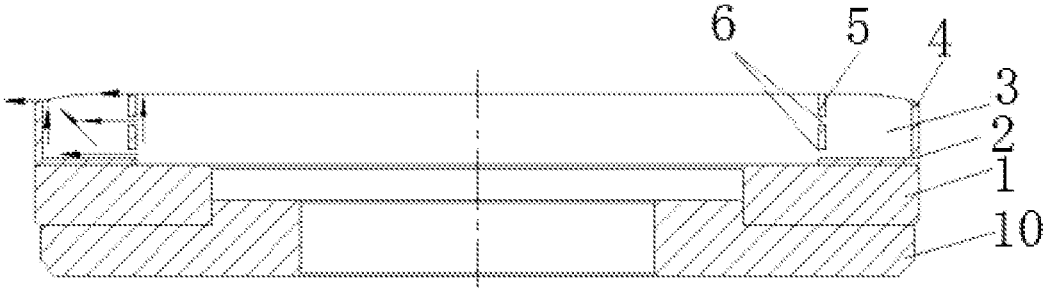
FIG. 15 is the sectional view along D-D of FIG. 14.

As shown in FIGS. 13-15, the water passage hole 6 is an annular structure, which is provided on the sidewall of the inner ring body 5 in two or more circles. Since the water passage hole 6 is provided on the sidewall of the inner ring body 5 in two circles, the first branch formed through the water passage hole 6 will have two paths.

The flow path of the first branch formed by a circle of water passage holes 6 away from the working surface is as follows: the first part of the cooling water enters the water passage channel 3 from the inside of the blade ring through the circle of water passage holes 6 away from the working surface, and after the cooling water enters the water passage channel 3, it flows down the inner wall of the outer ring body 4 toward the area of the working surface close to the outer side of the blade ring in the axial direction of the blade ring while being blocked by the outer ring body 4, thereby cooling the outer area of the working surface.

The flow path of the first branch formed by a circle of water passage holes 6 close to the working surface is as follows: the second part of the cooling water enters the water passage channel 3 from the interior of the blade ring through a circle of water passage holes 6 close to the working surface, and after the cooling water enters the water passage channel 3, it flows toward the middle area of the working surface in the axial direction of the blade ring under the blocking of the outer ring body 4 and the first part of the cooling water, thereby cooling the middle area of the working surface.

The flow path of the second branch is the same as that of the first embodiment. Finally, the outer area of the working surface, the area in the middle of the working surface and the inner area of the working surface are covered with the corresponding cooling water, which makes the cooling water more evenly distributed on the working surface and further improves the machining quality. In addition, when the cooling water is supplied from a working end face, the utilization of the cooling water can be improved.

Third Embodiment

In this embodiment, the structures of the outer ring body 4 and the inner ring body 5 are improved on the basis of the first embodiment or the second embodiment, and other parts are consistent with the first embodiment or the second embodiment. This embodiment will be described as follows.

Figure 16:
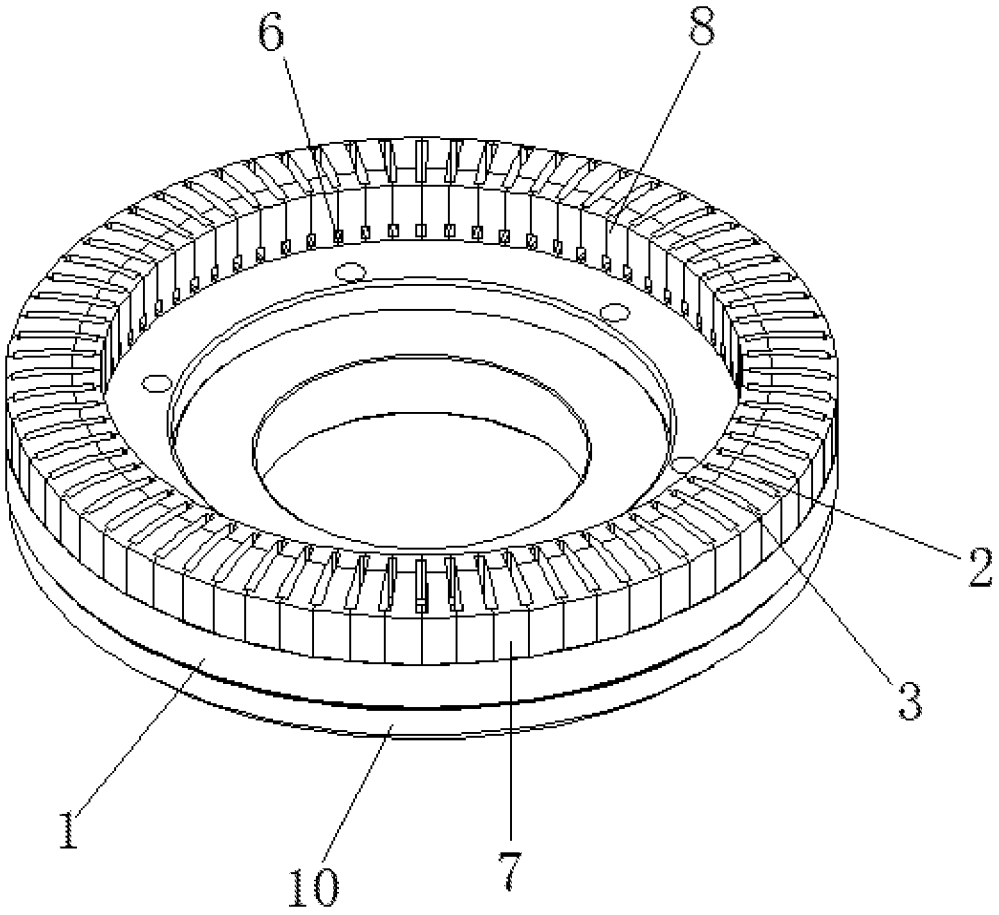
FIG. 16 is a three-dimensional view of a third embodiment in accordance with the present invention.
Figure 17:
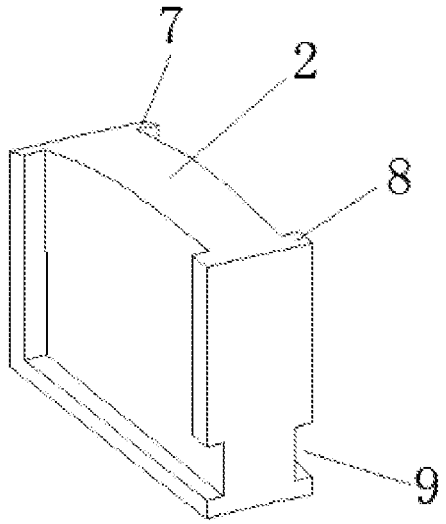
FIG. 17 is a three-dimensional view of a blade in the third embodiment in accordance with the present invention.

As shown in FIGS. 16 and 17, the inner and outer ends of the blade 2 are respectively provided with a first arc block 7 and a second arc block 8. Notches 9 are provided on two sides of the second arc block 8 respectively. After the blades 2 are fixed on the base 1, the first arc blocks 7 on all the blades 2 are spliced into the outer ring body 4, and the second arc blocks 8 on all the blades 2 are spliced into the inner ring body 5. When the two adjacent second arc blocks 8 are spliced together, the gaps 9 on them are butted to form the water passage hole 6 that communicates with the corresponding water passage channel 3. The first arc block 7 and the second arc block 8 are integrally formed with the corresponding blades 2. With the above design, when the blade 2 is assembled, the outer ring body 4, the inner ring body 5 and the water passage hole 6 are formed synchronously, which is beneficial to the assembly of the grinding wheel.

Fourth Embodiment

This embodiment improves the structure of the water passage channel 3 on the basis of the first embodiment, the second embodiment or the third embodiment, the other parts are consistent with the first embodiment, the second embodiment or the third embodiment, and the details are given as follows.

Figure 18:
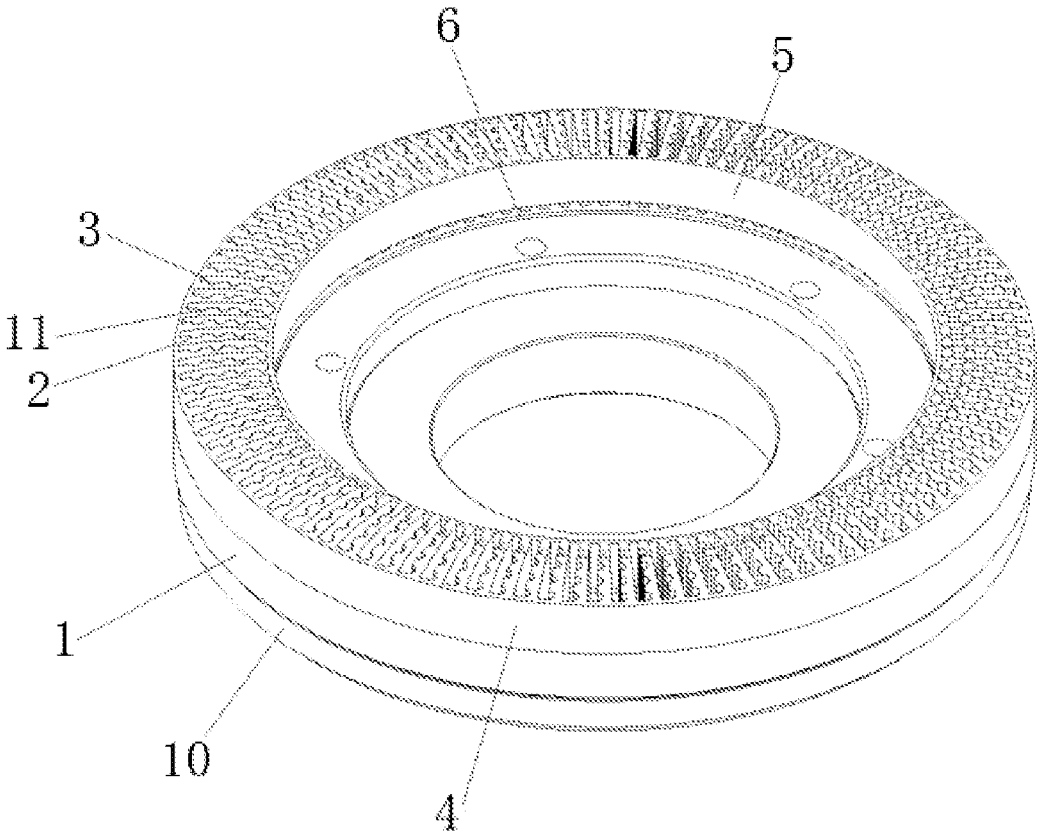
FIG. 18 is a three-dimensional view of the water passage channel having a straight channel structure with a groove on a side of the water passage channel in a fourth embodiment.
Figure 19:
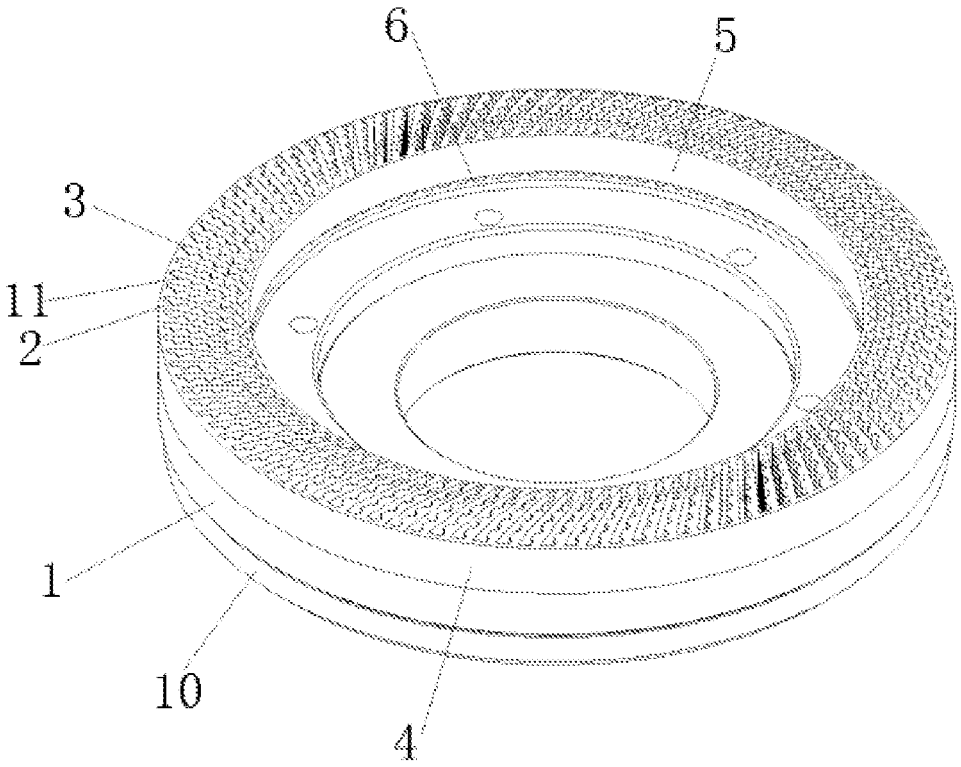
FIG. 19 is a three-dimensional view of the water passage channel having an oblique channel structure with a groove on a side of the water passage channel in the fourth embodiment.
Figure 20:
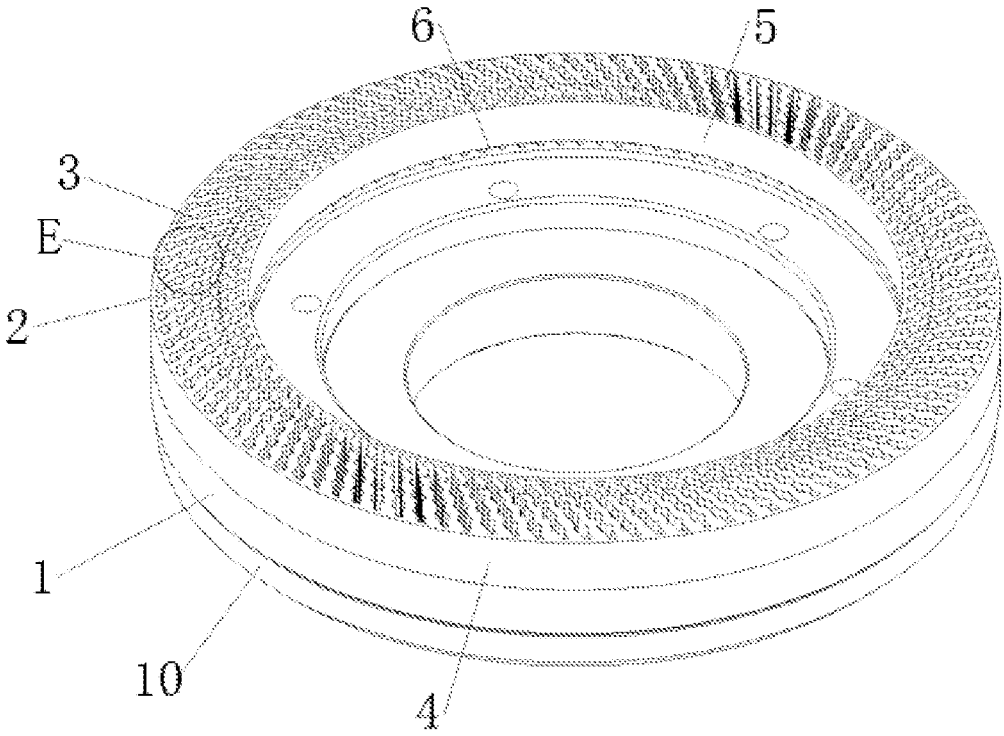
FIG. 20 is a three-dimensional view of the water passage channel having an oblique channel structure with grooves on both sides of the water passage channel in the fourth embodiment.
Figure 21:
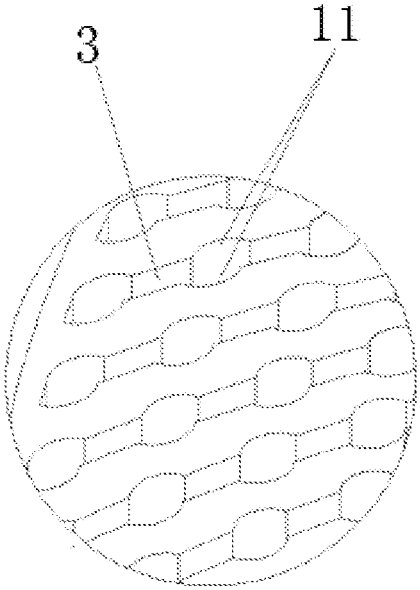
FIG. 21 is an enlarged view of detail E of FIG. 20.
Figure 22:
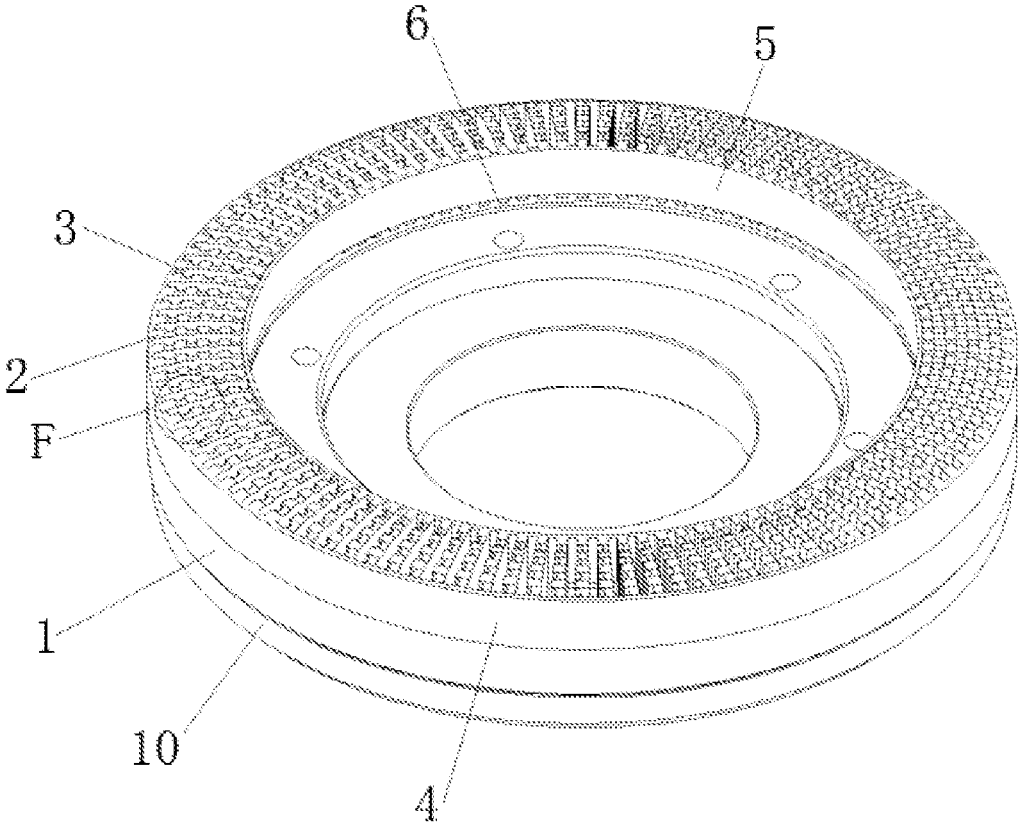
FIG. 22 is a three-dimensional view of a groove body with a mesh structure formed on the working surface after the blade ring is worn in the fourth embodiment.

As shown in FIGS. 18 and 19, a plurality of grooves 11 is provided on one side of the water passage channel 3, or as shown in FIGS. 20 and 21, or a plurality of grooves 11 is provided on both sides of the water passage channel 3. The water passage channel 3 may be a straight groove structure or an oblique groove structure. The position of the working surface corresponding to the groove 11 is prone to rapid wear, and a circumferential trough 12 is formed. The trough 12 and the water passage channel 3 are interlaced to form a slot with a mesh structure on the working surface. Since the groove 11 is provided on the sidewall of the water passage channel 3, the following advantages may be obtained.

First, the groove 11 has the function of storing cooling water such that more cooling water stays on the working surface to improve the cooling effect.

Figure 23:
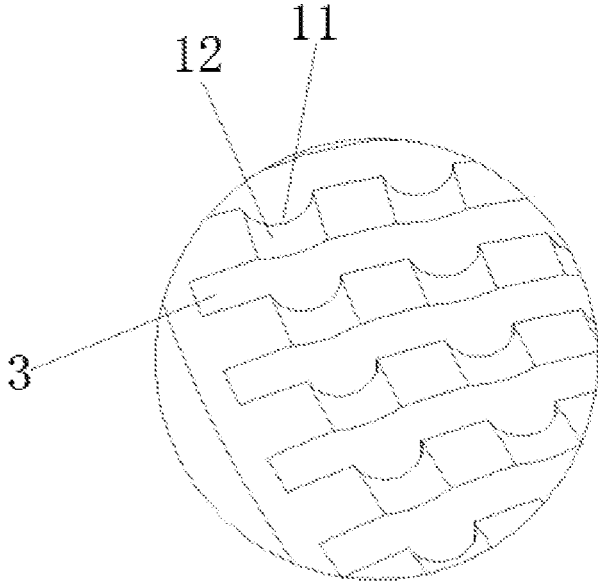
FIG. 23 is an enlarged view of a detail F of FIG. 22.
Figure 24:
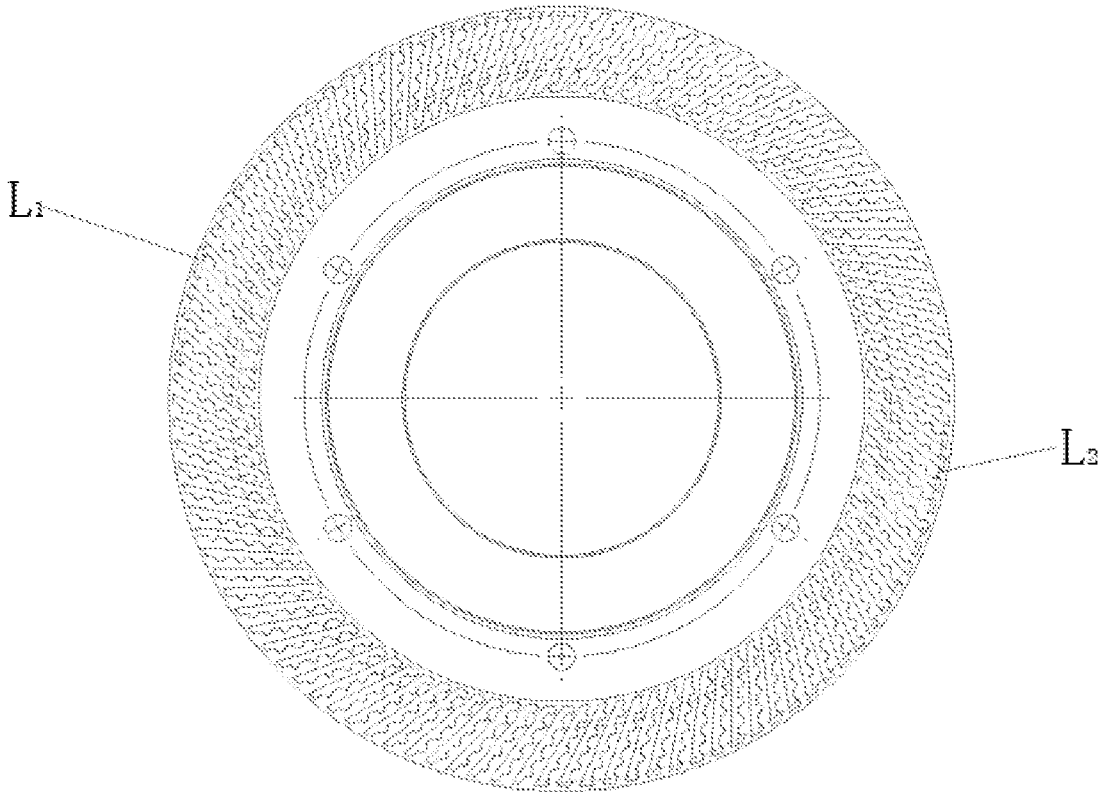
FIG. 24 is a schematic diagram of the arrangement of grooves on the same-diameter circumference.

Second, the groove 11 is designed so that on the circumference of each point of the working surface along the radial direction, the accumulated total circumferential length of the diamond (working material) contained in the working surface is unequal. In other words, the accumulated total circumferential length of the diamond contained in the working surface is shorter at the groove 11. As a result, so the grooves 11 are worn first. As shown in FIGS. 23 and 24, the trough 12 is formed by the groove 11 due to its rapid wear. The trough 12 and the adjacent water passage channel 3 are interlaced to form a slot with a mesh structure. The slot of the mesh structure makes the cooling water distributed to various positions on the working surface such that the cooling water can more easily cover the working surface in an all-around way and fully implement cooling, so as to improve the cooling effect.

In addition, the grooves 11 are arranged on different diameters of the blade ring, and the connecting lines of the grooves 11 on the same-diameter circumference of the blade ring are in the form of a single arc or multiple arcs that are uniformly distributed. The length of the single arc is at most half a circle of a corresponding circumference, and the cumulative length of the multiple arcs is at most half a circle of a corresponding circumference. As shown in FIG. 24, the dotted line $L_1$ and the dotted line $L_2$ represent the connecting line of the grooves 11 on the same-diameter circumference. That is, the connecting line of the grooves 11 on the circumference is two arcs ($L_1$ and $L_2$) that are uniformly disposed. The grooves 11 on the circumference of the same diameter are designed into the shape of waves that do not penetrate the entire circumference, that is, concave and convex parts are formed on the circumference. When the grinding wheel is edging, slight axial and radial vibrations will be generated, which can achieve an effect of impact-type intermittent grinding. The blockage from powder chips is frequently relaxed, which greatly increases the effects of chip removal and cooling.

Fifth Embodiment

In this embodiment, the processing technology of the grinding wheel whose water passage channel 3 is an inclined groove structure is improved on the basis of the first embodiment, the second embodiment, the third embodiment or the fourth embodiment, and other parts are the same as those of the first embodiment, the second embodiment, the third embodiment or the fourth embodiment. The details are given as follows.

When the rotational speed of the base 1 reaches 45 m/s or more, the end of the water passage channel 3 close to the outside of the blade ring is inclined by an angle θ toward the direction of rotation of the base with respect to an end of the water passage channel 3 close to inside of the blade ring, and the higher the linear rotational speed of the base 1, the greater the value of the angle θ.

Figure 25:
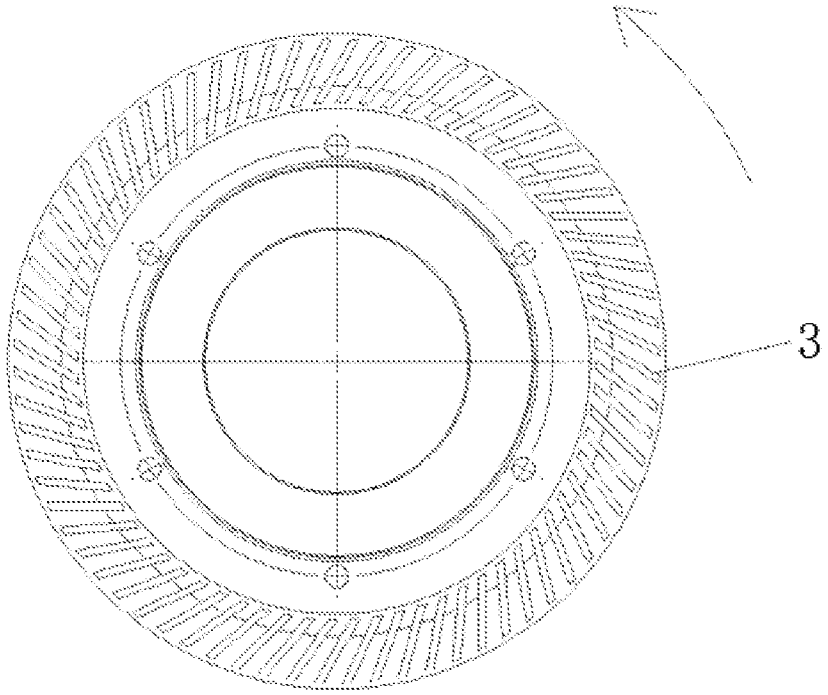
FIG. 25 is a schematic diagram of the direction of rotation of the grinding wheel being identical with the inclination direction of the water passage channel in the conventional processing technology.
Figure 26:
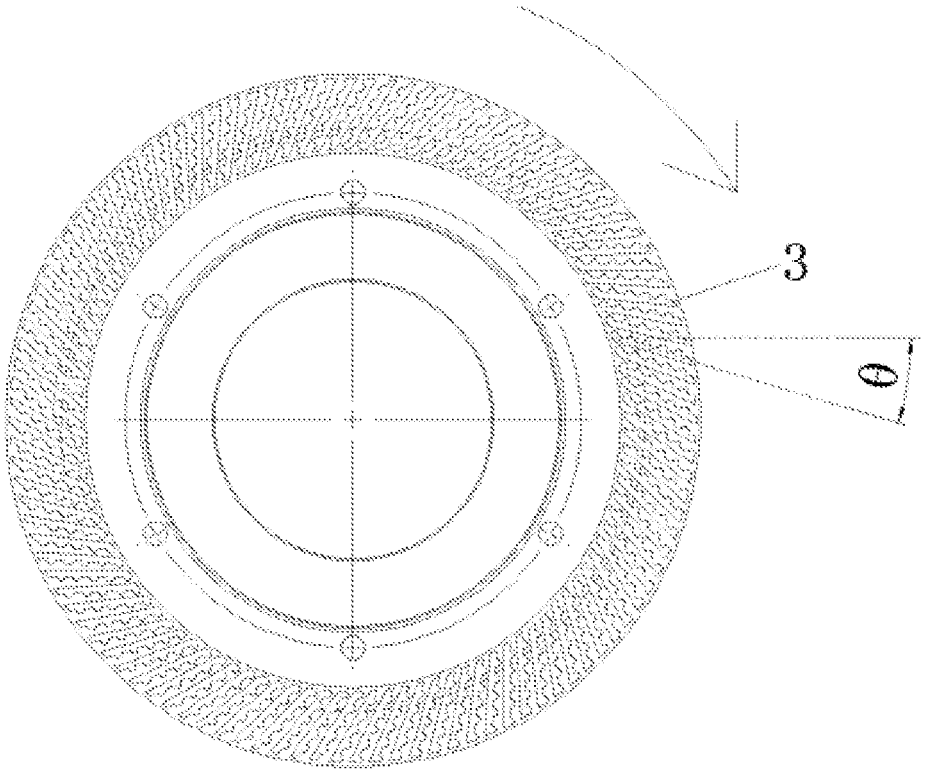
FIG. 26 is a schematic diagram of the rotation direction of the grinding wheel being opposite to the inclination direction of the water passage channel in a fifth embodiment.

For the grinding wheel with oblique groove structure, as shown in FIG. 25, the rotation direction of the grinding wheel/base 1 is forward rotation relative to the inclined direction of the water passage channel 3 in the traditional machining process, and the forward rotation is conducive to the outflow of cooling water. In this way, it makes the cooling water in the water passage channel 3 easier to be thrown out under the centrifugal force, thereby improving the cooling effect. However, when the grinding wheel rotates at a high speed and reaches a certain value, such as when the linear rotational speed reaches 45 m/s or more, the centrifugal force increases due to the high-speed rotation, so that too much cooling water is quickly thrown out from the end face of the outer ring of the grinding wheel, while the working surface of the inner ring lacks water for cooling. At this time, as shown in FIG. 26, the rotation direction of the grinding wheel/base 1 is changed such that the rotation direction thereof is reverse relative to the inclined direction of the water passage channel 3. The reverse rotation is not conducive to the outflow of cooling water, that is, the water passage channel 3 is arranged in the reverse direction, which achieves the effect of preventing rapid radial leakage of cooling water and forms a "spring" effect, which is conducive to enhancing the cooling effect of cooling water on the working surface.

The above are only preferred embodiments of the present disclosure and are not intended to limit the present invention. Any modifications, equivalent replacements, improvements and the like made within the spirit and principles of the present disclosure shall be encompassed in the protection scope of the present disclosure.

What is claimed is:

1. A high-rotational speed cup-shaped grinding wheel, comprising an annular base, a plurality of blades and a flow splitting structure; wherein the blades are arranged at an interval in a circumferential direction and are fixed on a side of the base to form a blade ring, a side of the blade ring away from the base is an annular working surface, and two adjacent blades are spaced apart to form a water passage channel for delivering a cooling water to the working surface; the flow splitting structure is fixed on the blade ring and divides the cooling water into two branches, wherein a first branch delivers the cooling water to an outer area of the working surface through an interior of the water passage channel under a centrifugal force due to a rotation of the base, and a second branch delivers the cooling water to an inner area of the working surface through an exterior of the water passage channel under a centrifugal force due to the rotation of the base, and delivers the cooling water from the inner area of the working surface to an outer side area thereof upon being blocked by a machined workpiece.

2. The high-rotational speed cup-shaped grinding wheel according to claim 1, wherein the flow splitting structure comprises an outer ring body and an inner ring body; the outer ring body is fixed on an outer side of the blade ring, the inner ring body is fixed on an inner side of the blade ring, and a water passage hole that is in communication with the water passage channel is provided at a sidewall of the inner ring body that corresponds to the water passage channel, whereby the first branch is formed from the water passage hole to the outer area of the working surface through the water passage channel, and the second branch is formed from an inner sidewall of the inner ring body to the inner area of the working surface.

3. The high-rotational speed cup-shaped grinding wheel according to claim 2, wherein the water passage hole is an annular structure, and is provided on the sidewall of the inner ring body in a circle.

4. The high-rotational speed cup-shaped grinding wheel according to claim 3, wherein the water passage hole is positioned on the sidewall of the inner ring body at an end away from the working surface.

5. The high-rotational speed cup-shaped grinding wheel according to claim 2, wherein the water passage hole is an annular structure, and is provided on the sidewall of the inner ring body in two or more circles.

6. The high-rotational speed cup-shaped grinding wheel according to claim 2, wherein inner and outer ends of the blade are respectively provided with a second arc block and a first arc block, and notches are respectively provided on both sides of the second arc block; after the blades are fixed on the base, the first arc blocks on all the blades are spliced to form the outer ring body, and the second arc blocks on all the blades are spliced to form the inner ring body; and after two adjacent second arc blocks are spliced, the notches on them are butted to form the water passage holes that communicate with the corresponding water passage channels.

7. The high-rotational speed cup-shaped grinding wheel according to claim 6, wherein the first arc block and the second arc block are integrally formed with the corresponding blades.

8. The high-rotational speed cup-shaped grinding wheel according to claim 1, wherein the water passage channel is a straight groove structure that is radially consistent with the base.

9. The high-rotational speed cup-shaped grinding wheel according to claim 1, wherein the water passage channel is an oblique groove structure radially inclined relative to the base.

10. The high-rotational speed cup-shaped grinding wheel according to claim 1, further comprising a connecting plate connected with a spindle of a machine tool; wherein the connecting plate is fixed on a side of the base away from the blade ring.

11. The high-rotational speed cup-shaped grinding wheel according to claim 1, wherein a plurality of grooves are provided on one or both sides of the water passage channel, a position of the working surface corresponding to the groove is prone to rapid wear and forms a circumferential trough, and the trough and the water passage channel are interlaced to form a slot with a mesh structure on the working surface.

12. The high-rotational speed cup-shaped grinding wheel according to claim 11, wherein the grooves are arranged on different diameters of the blade ring, a connecting line of the grooves on the same-diameter circumference of the blade ring is in a form of a single arc or multiple arcs that are uniformly disposed, a length of the single arc is at most half a circle of a corresponding circumference, and a cumulative length of the multiple arcs is at most half a circle of a corresponding circumference.

13. The high-rotational speed cup-shaped grinding wheel according to claim 2, wherein thicknesses of the outer ring body and the inner ring body are set at 3 mm or less or 1 mm or less.

14. The high-rotational speed cup-shaped grinding wheel according to claim 9, wherein when a linear rotational speed of the base reaches 45 m/s or more, an end of the water passage channel close to an outer side of the blade ring is inclined by an angle θ toward a direction of rotation of the base with respect to an end of the water passage channel close to an inner side of the blade ring, and the higher the linear rotational speed of the base, the greater the value of the angle θ.

15. The high-rotational speed cup-shaped grinding wheel according to claim 2, further comprising a connecting plate connected with a spindle of a machine tool; wherein the connecting plate is fixed on a side of the base away from the blade ring.

16. The high-rotational speed cup-shaped grinding wheel according to claim 3, further comprising a connecting plate connected with a spindle of a machine tool; wherein the connecting plate is fixed on a side of the base away from the blade ring.

17. The high-rotational speed cup-shaped grinding wheel according to claim 4, further comprising a connecting plate connected with a spindle of a machine tool; wherein the connecting plate is fixed on a side of the base away from the blade ring.

18. The high-rotational speed cup-shaped grinding wheel according to claim 5, further comprising a connecting plate connected with a spindle of a machine tool; wherein the connecting plate is fixed on a side of the base away from the blade ring.

19. The high-rotational speed cup-shaped grinding wheel according to claim 6, further comprising a connecting plate connected with a spindle of a machine tool; wherein the connecting plate is fixed on a side of the base away from the blade ring.

20. The high-rotational speed cup-shaped grinding wheel according to claim 7, further comprising a connecting plate connected with a spindle of a machine tool; wherein the connecting plate is fixed on a side of the base away from the blade ring.

* * * * *